US011463820B2

(12) United States Patent
Thomsen et al.

(10) Patent No.: US 11,463,820 B2
(45) Date of Patent: Oct. 4, 2022

(54) HEARING AID COMPRISING A DIRECTIONAL MICROPHONE SYSTEM

(71) Applicant: Oticon A/S, Smørum (DK)

(72) Inventors: Anders Højsgaard Thomsen, Smørum (DK); Steen Michael Munk, Smørum (DK); Anders Meng, Smørum (DK)

(73) Assignee: Oticon A/S, Smørum (DK)

( * ) Notice: Subject to any disclaimer, the term of this patent is extended or adjusted under 35 U.S.C. 154(b) by 0 days.

(21) Appl. No.: 17/029,613

(22) Filed: Sep. 23, 2020

(65) Prior Publication Data

US 2021/0092530 A1 Mar. 25, 2021

(30) Foreign Application Priority Data

Sep. 25, 2019 (EP) ..... 19199540

(51) Int. Cl.
*H04R 25/00* (2006.01)

(52) U.S. Cl.
CPC ..... *H04R 25/405* (2013.01); *H04R 25/50* (2013.01); *H04R 2225/021* (2013.01); *H04R 2225/025* (2013.01)

(58) Field of Classification Search
CPC . H04R 25/00; H04R 2225/49; H04R 2460/01
(Continued)

(56) References Cited

U.S. PATENT DOCUMENTS 5,875,254 A 2/1999 Hanright
2003/0012391 A1* 1/2003 Armstrong ..... H04R 25/407 381/312
(Continued)

FOREIGN PATENT DOCUMENTS

DE 10 2009 060 094 A1 6/2011
EP 2 490 459 A1 8/2012
(Continued)

*Primary Examiner* — Suhan Ni

(74) *Attorney, Agent, or Firm* — Birch, Stewart, Kolasch & Birch, LLP

(57) ABSTRACT

A hearing aid comprises a forward path comprising a) at least two input transducers, each for picking up sound from the environment of the hearing aid and providing respective at least two electric input signals; b) a beamformer filter for filtering said at least two electric input signals or signals originating therefrom and providing a spatially filtered signal; c) a signal processor for processing one or more of said electric input signals or one or more signals originating therefrom, and providing one or more processed signals based thereon; and d) an output transducer for generating stimuli perceivable by the user as sound based on said one or more processed signals. The hearing aid further comprises e) a feedback estimation system for estimating a current feedback from the output transducer to each of the at least two input transducers and providing respective feedback measures indicative thereof; and f) a controller configured to receive said feedback measures from said feedback estimation system and to switch between two modes of operation of the hearing aid, a one-input transducer (e.g. omni-directional) mode of operation, and a multi-input transducer (directional) mode of operation, in dependence of the feedback measures. to. The application further relates to a method of operating a hearing aid. Thereby the gain provided by the hearing aid to the user (without a significant risk of howl) can be maximized.

14 Claims, 5 Drawing Sheets

(58) Field of Classification Search
USPC ..... 381/312–313, 316–318, 320–321
See application file for complete search history.

(56) References Cited

U.S. PATENT DOCUMENTS

| | | | | |
|---|---|---|---|---|
| 2011/0150250 | A1 | 6/2011 | Pape et al. | |
| 2013/0170680 | A1* | 7/2013 | Gran | H04R 25/405 381/313 |
| 2016/0057547 | A1* | 2/2016 | Bürger | H04R 25/00 381/315 |
| 2017/0180878 | A1* | 6/2017 | Petersen | H04R 25/305 |

FOREIGN PATENT DOCUMENTS

| | | | |
|---|---|---|---|
| EP | 2 806 660 | A1 | 11/2014 |
| EP | 2 945 400 | A1 | 11/2015 |
| EP | 3 185 588 | A1 | 6/2017 |
| EP | 3 185 589 | A1 | 6/2017 |
| EP | 3 229 490 | A1 | 10/2017 |

* cited by examiner

HEARING AID COMPRISING A DIRECTIONAL MICROPHONE SYSTEM

SUMMARY

The present disclosure relates to hearing aids, e.g. to hearing aids adapted to compensate for a moderate to severe or severe to profound hearing loss. The disclosure specifically relates to directionality and feedback in hearing aids. EP3185589A1 deals with a scheme for reducing or handling acoustic feedback from a receiver (loudspeaker) located in the ear canal to a microphone system comprising one or more microphones located at or behind the ear and one or more microphones located at or in the ear canal.

A Hearing Aid:

The present disclosure relates to a hearing aid comprising a feedback estimation unit for controlling or influencing a directional or non-directional mode of operation of the hearing aid.

It is a well-known problem that a hearing aid can become unstable and howl when loop gain exceeds 1. The (open) loop gain is a product of the gain in the hearing aid and the coupling between the receiver (speaker) and a microphone, primarily, but not exclusively, through a vent or other opening in the earpiece. The vent (or other open structure) is generally inserted in the earpiece of hearing aids so as to avoid (or reduce) occlusion. The coupling between the receiver and a microphone is called the external or physical or acoustical feedback path and may have other origins than a deliberately arranged vent, e.g. mechanical coupling between various parts of the earpiece, etc.

The frequency dependent loop gain LG in the loop comprising the forward path and the electrical feedback path may be estimated as the sum of the (insertion) gain IG in the forward path, also termed 'forward gain' (e.g. fully or partially implemented by a signal processor (e.g. DSP or HLC in FIG. 1, 2A, 2B, 3A, 3B)) and the gain FBG in the electrical feedback path aimed at minimizing, preferably cancelling, the acoustical feedback between the receiver and the microphone of the hearing aid system (i.e. in a logarithmic representation, $LG(f)=IG(f)+FBG(f)$, where f is the frequency). In practice, the frequency range $\Delta f=[f_{min}; f_{max}]$ considered by the hearing aid system, e.g. limited to a part of the typical human audible frequency range, e.g. 20 $Hz \leq f \leq 20$ kHz, is divided into a number N of frequency bands (FB), e.g. $N \geq 16$, $(FB_1, FB_2, \ldots, FB_N)$ and the expression for the loop gain can be expressed in dependence of the frequency bands, i.e. $LG(FB_i)=IG(FB_i)+FBG(FB_i)$, $i=1, 2, \ldots, N$, or simply $LG=IG_i+FBG_i$.

A specific 'critical feedback mode' of operation may be defined and entered, either via a user interface or automatically, e.g. when a specific feedback criterion is fulfilled, e.g. when a current loop gain is larger than a threshold value, e.g. 0 dB (maybe for a certain minimum period of time, e.g. over a minimum number of time frames, e.g. ≥100 ms, or ≥500 ms). In an embodiment, the present scheme of controlling or influencing the switching between a directional and non-directional mode of operation is activated when the 'critical feedback mode' of operation' is entered. The control of the directional and non-directional modes of operation may be on a per frequency band level.

In an aspect, a hearing aid comprising a forward path comprising at least two input transducers (e.g. 2 or more microphones), a signal processor, and an output transducer is provided. The hearing aid further comprises a feedback estimation system for estimating a current feedback from the output transducer to each of the at least two input transducers and providing respective feedback measures indicative thereof. At a given point in time, the at least two input transducers may experience different feedback paths (e.g. as indicated by a feedback path difference measure being larger than a threshold value), as determined by the feedback estimation system (or a controller coupled to the feedback estimation system). The feedback path difference measure may be indicative of a difference between the respective feedback measures (of two of the at least two input transducers). In a non-directional mode of operation, the hearing aid is configured to—at a given time—choose the electric input signal from the input transducer having the smallest feedback measure as the electric input signal to be processed in the forward path (thus providing a signal with the best possible feedback margin, allowing the largest gain to be applied without a risk of howl).

In an embodiment, the hearing aid is configured to enter a single input transducer (e.g. a single microphone) omni-directional mode of operation (e.g. for low input level (high gain) or soft environments) in case the feedback path difference measure for two of the at least two input transducers is above a (first) threshold value. In an embodiment, the hearing aid is configured to only be allowed to enter a multi-input transducer (directional) mode of operation when the feedback margin on all input transducers (e.g. microphones) allow it, e.g. including that the feedback path difference measure is below a predefined (second) threshold value (or below respective individual threshold values) for all input transducer (e.g. microphone) pairs (contributing to the directional system, i.e. connected to a beamformer). In an embodiment, the hearing aid is fitted with a normal fitting rationale (e.g. NAL or DSL or a proprietary fitting rational such as Oticon's VAC) and configured to use a normal compression algorithm (e.g. compressive amplification).

The scheme according to the present disclosure has the advantage of allowing a higher gain to be applied, e.g. in ITE instruments (i.e. hearing aid types enclosed in a single, e.g. custom made, housing, adapted for being located in-the-ear (ITE), e.g. at or in the ear canal). ITE-instruments comprising a custom made (tightly fitting) ear-mould are especially valuable for hearing impaired users with a moderate to severe or severe to profound hearing loss (because such hearing instruments may produce a large sound pressure level at a user's ear drum and thus compensate for a large hearing loss). A scheme according to the present disclosure can e.g. be used to create smaller super- or ultra-power BTE type hearing aids allowing the use of directionality, when the microphone placement of one of the microphones is less critical (e.g. if the microphones are located a certain distance from the output transducer, e.g. in a BTE-part adapted for being located behind-the-ear (BTE)). Alternatively, the scheme may improve feedback performance for same size hearing aids.

In an embodiment, the hearing aid comprises a BTE-part adapted for being located at or behind an ear (pinna) of the user and an ITE-part adapted for being located at or in an ear canal of the user. The BTE-part and the ITE-part are electrically or acoustically connected to each other. The BTE-part as well as the ITE part may comprise at least one input transducer, e.g. a microphone. An input transducer in the BTE part and an input transducer in the ITE-part are typically asymmetrically located relative to the output transducer (be it located in the BTE-part or in the ITE-part). The BTE-part may comprise at least two input transducers (e.g. microphones), and the ITE part may comprise at least one input transducer, e.g. a microphone. The BTE-part as well as the ITE part may comprise at least two input transducers, e.g. microphones.

The ITE-part may form part of a hearing aid comprising other parts, e.g. a BTE-part. The BTE-part may comprise the output transducer. The ITE-part may constitute the hearing aid. The ITE-part may comprise the output transducer. The ITE-part may comprise at least two input transducers. The ITE-part may comprise a ventilation channel or opening (to diminish a user's perception of occlusion). The at least two input transducers in the ITE-part may be asymmetrically located in the ITE-part (e.g. in a housing of the ITE-part). Such asymmetric location may be a result of a design constraint due to components of the hearing aid, e.g. a battery (in particular in customized ITE-parts). Thereby the at least two input transducers (e.g. first and second microphones) may exhibit different feedback paths from the output transducer (e.g. loudspeaker).

An asymmetric location of two input transducers relative to the output transducer is taken to mean that they inherently exhibit different feedback paths. Different feedback paths may originate from asymmetric locations of input transducers relative to the output transducer (i.e. a stationary, relatively stable, inherent contribution to the feedback path difference). It may, however, also be due to an asymmetric feedback situation (e.g. due to different acoustic influences (e.g. from reflecting surfaces around the user) on the different input transducers, i.e. an asymmetric feedback situation of a more dynamic nature).

A hearing aid according to the present disclosure may comprise a scheme for entering or leaving a directional mode of operation (e.g. implementing a shift between an omni-directional and a directional mode of operation, the former providing a substantially omni-directional signal, the latter providing a beamformed signal). The scheme may be used to control the use of either a beamformed signal or one of the electric input signals from one of the at least two (e.g. omni-directional) input transducers as the signal for being presented to the user (after appropriate frequency/level dependent amplification/attenuation by the signal processor).

In an aspect of the present application, a hearing aid adapted to be located at or in an ear of a user and to compensate for a hearing loss of the user is provided. The hearing aid may comprise

- a forward path comprising
  - at least two input transducers, each for picking up sound from the environment of the hearing aid and providing respective at least two electric input signals;
  - a beamformer filter for filtering said at least two electric input signals or signals originating therefrom and providing a spatially filtered signal;
  - a signal processor for processing one or more of said electric input signals or one or more signals originating therefrom (e.g. said spatially filtered signal), and providing one or more processed signals based thereon, and
  - an output transducer for generating stimuli perceivable by the user as sound based on said one or more processed signals, and
  - a feedback estimation system for estimating a current feedback from the output transducer to each of the at least two input transducers and providing respective feedback measures indicative thereof.

The hearing aid may further comprise a controller configured to receive said feedback measures from said feedback estimation system.

The controller may be configured to switch between two modes of operation of the hearing aid, a one-input transducer (e.g. omni-directional) mode of operation, and a multi-input transducer (directional) mode of operation, in dependence of the feedback measures, e.g. the feedback path difference measure(s). The controller may be configured to switch between the two modes of operation in a specific critical feedback mode of operation (where a feedback criterion is fulfilled, e.g. in that a critical feedback has been detected or is estimated to be in development).

The controller may be configured to either

- in case a current feedback path difference measure between at least two of said feedback measures is larger than a first threshold value, select the electric input signal from the input transducer among the at least two input transducers having the smallest feedback measure, or a signal originating therefrom, as the input signal to the signal processor, and/or
- in case a feedback path difference measure between each of said feedback measures is smaller than a second threshold value, select the spatially filtered signal as the input signal to the signal processor.

The controller may be configured to receive the feedback measures from the feedback estimation system and to provide that the hearing aid enters a single-input transducer (e.g. omni-directional) mode of operation in case a current feedback path difference measure between at least two of the feedback measures is larger than a first threshold value, and to select the electric input signal from the input transducer among the at least two input transducers having the smallest feedback measure, or a signal originating therefrom, as the input signal to the signal processor.

The controller may be configured to receive the feedback measures from the feedback estimation system and to provide that the hearing aid enters a multi-input transducer (e.g. directional) mode of operation in case a feedback path difference measure between each of the feedback measures is smaller than a second threshold value, and to select the spatially filtered signal as the input signal to the signal processor.

The controller may comprises a feedback path difference measure unit configured to determine respective feedback path difference measures (e.g. in case of three input transducers IT1, IT2, IT3) $FBDM_{12}=FB\mathbf{1}est-FB\mathbf{2}est$, $FBDM_{13}=FB\mathbf{1}est-FB\mathbf{3}est$, and $FBDM_{23}=FB\mathbf{2}est-FB\mathbf{3}est$) and to provide a selection-control signal in dependence thereof (e.g. according to the, e.g. predefined, feedback criterion). The selection control signal may be configured to select the appropriate signal as the input signal to the signal processor (e.g. to select between an omni-directional and a directional mode of operation).

Thereby an improved hearing aid may be provided. Thereby the gain provided by the hearing aid to the user (without a significant risk of howl) can be maximized.

The first and second threshold values may be equal. The first and second threshold values may be different. The first and/or second threshold values may be frequency dependent. The first and/or second threshold values may be frequency independent.

The at least two input transducers may be asymmetrically located relative to the output transducer. This may e.g. be achieved when at least one of the at least two input transducers is/are located in the BTE part and at least one of the at least two input transducers is/are located in the ITE-part.

It may further be achieved when the at least two input transducers are located in the BTE-part (and the output transducer is located in the BTE-part or in the ITE-part), or when the at least two input transducers are located in the ITE-part (and the output transducer is e.g. located in the BTE-part or in the ITE-part).

The hearing aid may comprise at least three input transducers, e.g. two in a BTE-part and one in an ITE-part. A different location of the at least three input transducers provides an improved possibility to identify an input transducer with a relatively low feedback path (high gain margin) in many acoustic situations. A spatially filtered (directional) signal based on electric input signals from two input transducers located in the BTE-part, or feedback corrected versions thereof, may be provided. A spatially filtered (directional) signal based on electric input signals from two input transducers located in the BTE-part and from an input transducer located in the ITE-part, or feedback corrected versions thereof, may be provided. The scheme according to the present disclosure may be used to—in a specific critical feedback mode of operation—select between A) a single of the at least three electric input signals and B) either B1) the beamformed signal based on the BTE-microphone signals or B2) the beamformed signal based on all three input signals (the selection between B1) and B2) may e.g. be predetermined, or adaptively determined, e.g. in dependence of a feedback criterion).

The feedback measure for a given input transducer may e.g. comprise an impulse response of the feedback path from the output transducer to the input transducer in question. The feedback measure for a given input transducer may e.g. comprise a frequency response of the feedback path from the output transducer to the input transducer in question, e.g. represented by a feedback gain (e.g. measured at a number of frequencies). The feedback path difference measure for two of the feedback paths (e.g. between the feedback paths of first and second input transducers, e.g. microphones) may e.g. be based on an algebraic difference between the respective feedback measures, e.g. an absolute value of such difference. The feedback path difference measure may e.g. be a sum of differences (or squared differences) of corresponding values of the respective feedback measures (e.g. of individual time samples of the respective impulse responses, or of individual values at different frequencies of the respective frequency responses). Alternatively, the feedback path difference measure may be based on other difference measures, e.g. a ratio of two feedback path estimates, or a logarithm of the ratio, etc. The feedback path difference measure may e.g. be based on a mathematical distance measure, e.g. an Euclidian distance, or a squared Euclidian distance. The feedback path difference measure for two feedback paths (to two input transducers) may be arranged to be larger, the larger the algebraic (e.g. the absolute value of) difference between the two feedback paths are.

The feedback measure for a given input transducer may comprise an impulse response of the feedback path from the output transducer to the input transducer in question, or a frequency response of the feedback path from the output transducer to the input transducer in question, the latter being measured at a number of frequencies.

The feedback path difference measure between at least two of said feedback measures may be based on an algebraic difference between the respective feedback measures.

The feedback path difference measure may be determined as a sum of differences, or squared differences, of corresponding individual time samples of respective impulse responses, or of (corresponding) individual values at different frequencies of respective frequency responses. The hearing aid may be adapted to compensate for a moderate to severe or a severe to profound hearing loss of the user. A moderate hearing loss may be defined as a hearing loss in the range between 40 and 70 dB. A severe hearing loss may be defined as a hearing loss in the range between 70 and 90 dB. A profound hearing loss may be defined as a hearing loss in the range above 90 dB.

The hearing aid may comprise a BTE-part adapted for being located at or behind an ear (pinna) of the user and an ITE-part adapted for being located at or in an ear canal of the user, wherein the BTE-part and the ITE-part are electrically or acoustically connected to each other.

The BTE-part as well as the ITE part may comprise at least one of said multitude of input transducers. The (DIR/OMNI) mode selection scheme according to the present disclosure may be applied to a hearing aid comprising the BTE—as well as IT-parts and each comprising at least one or the at least two input transducers.

The hearing aid may comprise an ITE-part adapted for being located at or in an ear canal of the user, wherein the ITE-part comprises said at least two input transducers and said output transducer. The ITE-part of the hearing device may comprise a (e.g. customized) housing (e.g. an ear mould). The housing may comprise a ventilation channel (cf. e.g. Vent in FIG. 3B). In an embodiment, the design of the ITE-part and the location of the vent and the input transducers may induce a generally different feedback path from the output transducer (cf. FIG. 3B, microphone $M_1$ is closer to the ventilation channel than microphone $M_2$). The scheme for controlling the use of either a beamformed signal or the signal from a single one of the input transducers in the forward path of the hearing aid may be applied to such ITE-hearing aid to provide more design freedom as regards the location of the input transducers and the ventilation channel relative to each other. Thereby a larger maximum gain can be allowed (e.g. a larger full on gain). The hearing aid may be constituted by the ITE-part (e.g. in the form of an ITE-style, e.g. custom fit, e.g. invisible in the canal (IIC) or completely in the canal (CIC) or in the canal (ITC) hearing aid).

The hearing aid may comprise a filter bank. The hearing aid (e.g. the filter bank) may comprise or implement a time to time-frequency converter configured to provide said at least two electric input signals, or signals derived therefrom, as respective frequency sub-band signals. A time to time-frequency converter may e.g. be provided in each input transducer path (cf. units 't/f' in FIG. 2A) to convert a (possibly digitized) electric input signal (or a processed version thereof) from a time domain signal to a frequency domain signal (comprising a number K of frequency sub-band signals, e.g. represented by (complex) discrete values of the signals IN(k,m) where k and m are frequency and time indices. The processing of signals of the forward path may e.g. be performed in the time-frequency domain. The hearing aid may comprise a synthesis filter bank to convert a frequency sub-band signal to a time domain signal (cf. unit f/t in FIG. 2A). A distortion free filter bank for a hearing aid is e.g. described in EP3229490A1.

The beamformer filter may be configured to provide said spatially filtered signal as respective frequency sub-band signals.

The beamformer filter may be configured to be individually set in omni-directional or directional mode in the respective frequency sub-bands.

The hearing aid may be configured to provide that the controller selects the spatially filtered signal or one of the electric input signals, or a signal originating therefrom, as the input signal to the signal processor, individually for different frequency ranges based on said frequency sub-band signals, and a feedback criterion.

The feedback measures may be indicative of mechanical feedback. Selection of the spatially filtered signal or one of the electric input signals, or a signal originating therefrom, as the input signal to the signal processor as proposed by the present disclosure may e.g. be used to increase the maximum full-on gain for the hearing aid.

The feedback measures may be indicative of acoustic feedback.

The first and second threshold values for the feedback path difference measures may e.g. be determined for a given hearing aid of a given user in dependence of the hearing loss profile of the user (and thus the necessary gain, as e.g. provided by a fitting algorithm).

In an embodiment, the first and second threshold values for the feedback path difference measures are predetermined, e.g. during a fitting session, where processing parameters of the hearing aid (of a specific style) are adapted to the user in question. The first and second threshold values for the feedback path difference measures may however also be dynamically determined in dependence of a current requested gain and the current respective feedback measures.

The hearing aid may be adapted to provide a frequency dependent gain and/or a level dependent compression and/or a transposition (with or without frequency compression) of one or more frequency ranges to one or more other frequency ranges, e.g. to compensate for a hearing impairment of a user. The signal processor may be configured to enhance the electric input signals representing sound and providing a processed output signal. The signal processor may be configured to apply a number of processing algorithms to the electric input signal(s).

The hearing aid comprises an output transducer for providing a stimulus perceived by the user as an acoustic signal based on a processed electric signal from the signal processor. The output transducer may comprise a receiver (loudspeaker) for providing the stimulus as an acoustic signal to the user. The output transducer may comprise a vibrator for providing the stimulus as mechanical vibration of a skull bone to the user (e.g. in a bone-conducting, e.g. a bone-attached or bone-anchored hearing aid).

The multitude of input transducers may comprise a microphone or a multitude of microphones, each for converting an input sound to an electric input signal.

The hearing aid comprises a directional microphone system (the beamformer filter) adapted to spatially filter sounds from the environment, and thereby enhance a target acoustic source among a multitude of acoustic sources in the local environment of the user wearing the hearing aid. In an embodiment, the directional system is adapted to detect (such as adaptively detect) from which direction a particular part of the microphone signal originates. This can be achieved in various different ways as e.g. described in the prior art. In hearing aids, a microphone array beamformer is often used for spatially attenuating background noise sources. Many beamformer variants can be found in literature, see, e.g., [Brandstein & Ward; 2001] and the references therein. The minimum variance distortionless response (MVDR) beamformer is widely used in microphone array signal processing. Ideally the MVDR beamformer keeps the signals from the target direction (also referred to as the look direction) unchanged, while attenuating sound signals from other directions maximally. The generalized sidelobe canceller (GSC) structure is an equivalent representation of the MVDR beamformer offering computational and numerical advantages over a direct implementation in its original form.

The hearing aid may comprise a wireless receiver for receiving a wireless signal comprising sound and for providing an electric input signal representing said sound. The hearing aid may comprise antenna and transceiver circuitry adapted to establish a wireless link to another device, e.g. another hearing aid or a communication device, e.g. a smartphone. Preferably, frequencies used to establish a communication link between the hearing aid and the other device is below 70 GHz. The wireless link may be based on a standardized or proprietary technology. The wireless link may be based on Bluetooth technology (e.g. Bluetooth Low-Energy technology), or equivalent.

The hearing aid may be a portable, e.g. wearable, device, e.g. a device comprising a local energy source, e.g. a battery, e.g. a rechargeable battery.

The hearing aid comprises a forward or signal path between an input transducer, such as a microphone or a microphone system and/or direct electric input (e.g. a wireless receiver)) and the output transducer. The signal processor is located in the forward path. The signal processor is adapted to provide a frequency dependent gain according to a user's particular needs. The hearing aid may comprise an analysis path comprising functional components for analyzing the input signal(s) (e.g. determining a level, a modulation, a type of signal, an acoustic feedback estimate, etc.). Some or all signal processing of the analysis path and/or the forward path may be conducted in the frequency domain. Some or all signal processing of the analysis path and/or the signal path may be conducted in the time domain.

The hearing aid may comprise an analogue-to-digital (AD) converter to digitize an analogue input (e.g. from an input transducer, such as a microphone) with a predefined sampling rate $f_s$, $f_s$ being e.g. in the range from 8 kHz to 48 kHz (adapted to the particular needs of the application, e.g. 20 kHz). The AD-converter provides digital samples $x_n$ (or x[n]) at discrete points in time $t_n$ (or n). Each audio sample represents the value of the acoustic signal at $t_n$ by a predefined number $N_b$ of bits, $N_b$ being e.g. in the range from 1 to 48 bits, e.g. 24 bits. Each audio sample is hence quantized using $N_b$ bits (resulting in $2^{Nb}$ different possible values of the audio sample). A digital sample x has a length in time of $1/f_s$, e.g. 50 μs, for $f_s$=20 kHz. A number of audio samples may be arranged in a time frame. A time frame may comprise 64 or 128 (or more) audio data samples. Other frame lengths may be used depending on the practical application. In an embodiment, the hearing aid comprises a digital-to-analogue (DA) converter to convert a digital signal to an analogue output signal, e.g. for being presented to a user via an output transducer.

The hearing aid, e.g. the input transducer, and/or the antenna and transceiver circuitry may comprise a time-frequency (TF) conversion unit, e.g. an analysis filter bank, for providing a time-frequency representation of an input signal. The time-frequency representation may comprise an array or map of corresponding complex or real values of the signal in question in a particular time and frequency range (a spectrogram). The TF conversion unit may comprise a filter bank for filtering a (time varying) input signal and providing a number of (time varying) frequency sub-band signals each comprising a distinct frequency range of the input signal. The TF conversion unit may comprise a Fourier transformation unit for converting a time variant input signal to a (time variant) signal in the (time-)frequency domain. The frequency range considered by the hearing aid may extend from a minimum frequency $f_{min}$ to a maximum frequency $f_{max}$ comprising a part of the typical human audible frequency range from 20 Hz to 20 kHz, e.g. at least a part of the range from 20 Hz to 12 kHz. Typically, a sample rate $f_s$ is larger than or equal to twice the maximum frequency $f_{max}$, $f_s \geq 2f_{max}$. In an embodiment, a signal of the forward and/or analysis path of the hearing aid is split into a number NI of frequency bands (e.g. of uniform width), where NI is e.g. larger than 5, such as larger than 10, such as larger than 50, such as larger than 100, at least some of which are processed individually. The frequency bands may be uniform in width. The hearing aid may be adapted to process a signal of the forward and/or analysis path in a number NP of different frequency channels (NP≤NI). The frequency channels may be uniform or non-uniform in width (e.g. increasing in width with frequency), overlapping or non-overlapping.

In an embodiment, the hearing aid comprises a number of detectors configured to provide status signals relating to a current physical environment of the hearing aid (e.g. the current acoustic environment), and/or to a current state of the user wearing the hearing aid, and/or to a current state or mode of operation of the hearing aid. Alternatively or additionally, one or more detectors may form part of an external device in communication (e.g. wirelessly) with the hearing aid. An external device may e.g. comprise another hearing aid, a remote control, and audio delivery device, a telephone (e.g. a Smartphone), an external sensor, etc.

In an embodiment, one or more of the number of detectors operate(s) on the full band signal (time domain). In an embodiment, one or more of the number of detectors operate (s) on band split signals ((time-) frequency domain), e.g. in a limited number of frequency bands.

In an embodiment, the number of detectors comprises a level detector for estimating a current level of a signal of the forward path. In an embodiment, the predefined criterion comprises whether the current level of a signal of the forward path is above or below a given (L-)threshold value. In an embodiment, the level detector operates on the full band signal (time domain). In an embodiment, the level detector operates on band split signals ((time-) frequency domain).

In a particular embodiment, the hearing aid comprises a voice detector (VD) for estimating whether or not (or with what probability) an input signal comprises a voice signal (at a given point in time). A voice signal is in the present context taken to include a speech signal from a human being. It may also include other forms of utterances generated by the human speech system (e.g. singing). In an embodiment, the voice detector unit is adapted to classify a current acoustic environment of the user as a VOICE or NO-VOICE environment. This has the advantage that time segments of the electric microphone signal comprising human utterances (e.g. speech) in the user's environment can be identified, and thus separated from time segments only (or mainly) comprising other sound sources (e.g. artificially generated noise). In an embodiment, the voice detector is adapted to detect as a VOICE also the user's own voice. Alternatively, the voice detector is adapted to exclude a user's own voice from the detection of a VOICE.

In an embodiment, the hearing aid comprises an own voice detector for estimating whether or not (or with what probability) a given input sound (e.g. a voice, e.g. speech) originates from the voice of the user of the system. In an embodiment, a microphone system of the hearing aid is adapted to be able to differentiate between a user's own voice and another person's voice and possibly from NON-voice sounds.

In an embodiment, the number of detectors comprises a movement detector, e.g. an acceleration sensor. In an embodiment, the movement detector is configured to detect movement of the user's facial muscles and/or bones, e.g. due to speech or chewing (e.g. jaw movement) and to provide a detector signal indicative thereof.

In an embodiment, the number of detectors comprises a feedback detector. The feedback detector may be configured to estimate an amount of or a risk of feedback. The feedback detector may be configured to indicate whether or not a specific feedback criterion is fulfilled. A feedback detector is e.g. described in EP3185588A1.

The hearing aid comprises an acoustic (and/or mechanical) feedback control system. Acoustic feedback occurs because the output loudspeaker signal from an audio system providing amplification of a signal picked up by a microphone is partly returned to the microphone via an acoustic coupling through the air or other media. The part of the loudspeaker signal returned to the microphone is then re-amplified by the system before it is re-presented at the loudspeaker, and again returned to the microphone. As this cycle continues, the effect of acoustic feedback becomes audible as artifacts or even worse, howling, when the system becomes unstable. The problem appears typically when the microphone and the loudspeaker are placed closely together, as e.g. in hearing aids or other audio systems. Some other classic situations with feedback problem are telephony, public address systems, headsets, audio conference systems, etc. Adaptive feedback cancellation has the ability to track feedback path changes over time. It is based on a linear time invariant filter to estimate the feedback path but its filter weights are updated over time. The filter update may be calculated using stochastic gradient algorithms, including some form of the Least Mean Square (LMS) or the Normalized LMS (NLMS) algorithms. They both have the property to minimize the error signal in the mean square sense with the NLMS additionally normalizing the filter update with respect to the squared Euclidean norm of some reference signal.

In an embodiment, the feedback control system comprises a feedback estimation unit for providing a feedback signal representative of an estimate of the acoustic feedback path, and a combination unit, e.g. a subtraction unit, for subtracting the feedback signal from a signal of the forward path (e.g. as picked up by an input transducer of the hearing aid). In an embodiment, the feedback estimation unit comprises an update part comprising an adaptive algorithm and a variable filter part for filtering an input signal according to variable filter coefficients determined by said adaptive algorithm, wherein the update part is configured to update said filter coefficients of the variable filter part with a configurable update frequency $f_{upd}$.

In an embodiment, the hearing aid further comprises other relevant functionality for the application in question, e.g. compression, noise reduction, etc.

Use:

In an aspect, use of a hearing aid as described above, in the 'detailed description of embodiments' and in the claims, is moreover provided. In an embodiment, use is provided in a system comprising audio distribution, e.g. a system comprising a microphone and a loudspeaker in sufficiently close proximity of each other to cause feedback from the loudspeaker to the microphone during operation by a user. In an embodiment, use is provided in a system comprising one or more hearing aids (e.g. hearing instruments), headsets, ear phones, active ear protection systems, etc., e.g. in handsfree telephone systems, teleconferencing systems, public address systems, karaoke systems, classroom amplification systems, etc.

A Method:

In an aspect, a method of operating a hearing aid adapted to be located at or in an ear of a user and to compensate for a hearing loss of the user is furthermore provided by the present application. The method may comprise

- providing at least two electric input signals representing sound in the environment of the hearing aid as picked up by respective at least two input transducers;
- providing a spatially filtered signal based on said at least two electric input signals;
- processing one or more of said electric input signals or one or more signals originating therefrom, and providing one or more processed signals based thereon;
- generating stimuli for an output transducer perceivable by the user as sound based on said one or more processed signals;
- estimating a current feedback from said output transducer to each of the at least two input transducers and providing respective feedback measures indicative thereof;
- providing that—at a given time—either
  - selecting the electric input signal from the input transducer among the at least two input transducers having the smallest feedback measure, or a signal originating therefrom, as the input signal to the processing, in case a feedback path difference measure between at least two of said feedback measures is larger than a first threshold value, and/or
  - selecting the spatially filtered signal as the input signal to the processing, in case a feedback path difference measure between each of said feedback measures is(are) smaller than a second threshold value.

In a further aspect, a method of operating a hearing aid adapted to be located at or in an ear of a user and to compensate for a hearing loss of the user is provided. The method comprises

- providing at least two electric input signals representing sound in the environment of the hearing aid as picked up by respective at least two input transducers;
- providing a spatially filtered signal based on said at least two electric input signals;
- processing one or more of said electric input signals or one or more signals originating therefrom, and providing one or more processed signals based thereon;
- generating stimuli for an output transducer perceivable by the user as sound based on said one or more processed signals;
- estimating a current feedback from said output transducer to each of the at least two input transducers and providing respective feedback measures indicative thereof;
- switching between two modes of operation of the hearing aid, a one-input transducer (e.g. omni-directional) mode of operation, and a multi-input transducer (directional) mode of operation, in dependence of the feedback measures.

It is intended that some or all of the structural features of the device described above, in the 'detailed description of embodiments' or in the claims can be combined with embodiments of the method, when appropriately substituted by a corresponding process and vice versa. Embodiments of the method have the same advantages as the corresponding devices.

A Hearing System:

In a further aspect, a hearing system comprising a hearing aid as described above, in the 'detailed description of embodiments', and in the claims, AND an auxiliary device is moreover provided.

In an embodiment, the hearing system is adapted to establish a communication link between the hearing aid and the auxiliary device to provide that information (e.g. control and status signals, possibly audio signals) can be exchanged or forwarded from one to the other.

The auxiliary device may comprise a smartphone, or other portable or wearable electronic device, such as a smartwatch or the like.

In an embodiment, the auxiliary device is or comprises a remote control for controlling functionality and operation of the hearing aid(s). In an embodiment, the function of a remote control is implemented in a SmartPhone, the SmartPhone possibly running an APP allowing to control the functionality of the audio processing device via the SmartPhone (the hearing aid(s) comprising an appropriate wireless interface to the SmartPhone, e.g. based on Bluetooth or some other standardized or proprietary scheme).

In an embodiment, the auxiliary device is or comprises an audio delivery device, e.g. an audio gateway device adapted for receiving a multitude of audio signals (e.g. from an entertainment device, e.g. a TV or a music player, a telephone apparatus, e.g. a mobile telephone or a computer, e.g. a PC) and adapted for selecting and/or combining an appropriate one of the received audio signals (or combination of signals) for transmission to the hearing aid.

In an embodiment, the auxiliary device is or comprises another hearing aid. In an embodiment, the hearing system comprises two hearing aids adapted to implement a binaural hearing system, e.g. a binaural hearing aid system.

An APP:

In a further aspect, a non-transitory application (e.g. a software program), termed an APP, is furthermore provided by the present disclosure. The APP comprises executable instructions configured to be executed on an auxiliary device to implement a user interface for a hearing aid or a hearing system described above in the 'detailed description of embodiments', and in the claims. In an embodiment, the APP is configured to run on cellular phone, e.g. a smartphone, or on another portable device allowing communication with said hearing aid or said hearing system.

Definitions:

In the present context, a 'hearing aid' refers to a device, e.g. a hearing instrument, or an active ear-protection device, or other audio processing device, which is adapted to improve, augment and/or protect the hearing capability of a user by receiving acoustic signals from the user's surroundings, generating corresponding audio signals, possibly modifying the audio signals and providing the possibly modified audio signals as audible signals to at least one of the user's ears. Such audible signals may e.g. be provided in the form of acoustic signals radiated into the user's outer ears, acoustic signals transferred as mechanical vibrations to the user's inner ears through the bone structure of the user's head and/or through parts of the middle ear.

The hearing aid may be configured to be worn in any known way, e.g. as a unit arranged behind the ear with a tube leading radiated acoustic signals into the ear canal or with an output transducer, e.g. a loudspeaker, arranged close to or in the ear canal, as a unit entirely or partly arranged in the pinna and/or in the ear canal, as a unit, e.g. a vibrator, attached to a fixture implanted into the skull bone, as an attachable, or entirely or partly implanted, unit, etc. The hearing aid may comprise a single unit or several units communicating electronically with each other. The loudspeaker may be arranged in a housing together with other components of the hearing aid, or may be an external unit in itself (possibly in combination with a flexible guiding element, e.g. a dome-like element).

More generally, a hearing aid comprises an input transducer for receiving an acoustic signal from a user's surroundings and providing a corresponding input audio signal and/or a receiver for electronically (i.e. wired or wirelessly) receiving an input audio signal, a (typically configurable) signal processing circuit (e.g. a signal processor, e.g. comprising a configurable (programmable) processor, e.g. a digital signal processor) for processing the input audio signal and an output unit for providing an audible signal to the user in dependence on the processed audio signal. The signal processor may be adapted to process the input signal in the time domain or in a number of frequency bands. In some hearing aids, an amplifier and/or compressor may constitute the signal processing circuit. The signal processing circuit typically comprises one or more (integrated or separate) memory elements for executing programs and/or for storing parameters used (or potentially used) in the processing and/or for storing information relevant for the function of the hearing aid and/or for storing information (e.g. processed information, e.g. provided by the signal processing circuit), e.g. for use in connection with an interface to a user and/or an interface to a programming device. In some hearing aids, the output unit may comprise an output transducer, such as e.g. a loudspeaker for providing an air-borne acoustic signal or a vibrator for providing a structure-borne or liquid-borne acoustic signal.

In some hearing aids, the vibrator may be adapted to provide a structure-borne acoustic signal transcutaneously or percutaneously to the skull bone. In some hearing aids, the vibrator may be implanted in the middle ear and/or in the inner ear. In some hearing aids, the vibrator may be adapted to provide a structure-borne acoustic signal to a middle-ear bone and/or to the cochlea. In some hearing aids, the vibrator may be adapted to provide a liquid-borne acoustic signal to the cochlear liquid, e.g. through the oval window.

A hearing aid may be adapted to a particular user's needs, e.g. a hearing impairment. A configurable signal processing circuit of the hearing aid may be adapted to apply a frequency and level dependent compressive amplification of an input signal. A customized frequency and level dependent gain (amplification or compression) may be determined in a fitting process by a fitting system based on a user's hearing data, e.g. an audiogram, using a fitting rationale (e.g. adapted to speech). The frequency and level dependent gain may e.g. be embodied in processing parameters, e.g. uploaded to the hearing aid via an interface to a programming device (fitting system) and used by a processing algorithm executed by the configurable signal processing circuit of the hearing aid.

A 'hearing system' refers to a system comprising one or two hearing aids, and a 'binaural hearing system' refers to a system comprising two hearing aids and being adapted to cooperatively provide audible signals to both of the user's ears. Hearing systems or binaural hearing systems may further comprise one or more 'auxiliary devices', which communicate with the hearing aid(s) and affect and/or benefit from the function of the hearing aid(s). Auxiliary devices may be e.g. remote controls, audio gateway devices, mobile phones (e.g. SmartPhones), or music players.

Hearing aids, hearing systems or binaural hearing systems may e.g. be used for compensating for a hearing-impaired person's loss of hearing capability, augmenting or protecting a normal-hearing person's hearing capability and/or conveying electronic audio signals to a person. Hearing aids or hearing systems may e.g. form part of or interact with public-address systems, active ear protection systems, handsfree telephone systems, car audio systems, entertainment (e.g. karaoke) systems, teleconferencing systems, classroom amplification systems, etc.

BRIEF DESCRIPTION OF DRAWINGS

The aspects of the disclosure may be best understood from the following detailed description taken in conjunction with the accompanying figures. The figures are schematic and simplified for clarity, and they just show details to improve the understanding of the claims, while other details are left out. Throughout, the same reference signs are used for identical or corresponding parts. The individual features of each aspect may each be combined with any or all features of the other aspects. These and other aspects, features and/or technical effect will be apparent from and elucidated with reference to the illustrations described hereinafter in which:

The figures are schematic and simplified for clarity, and they just show details which are essential to the understanding of the disclosure, while other details are left out. Throughout, the same reference signs are used for identical or corresponding parts.

Figure 1:
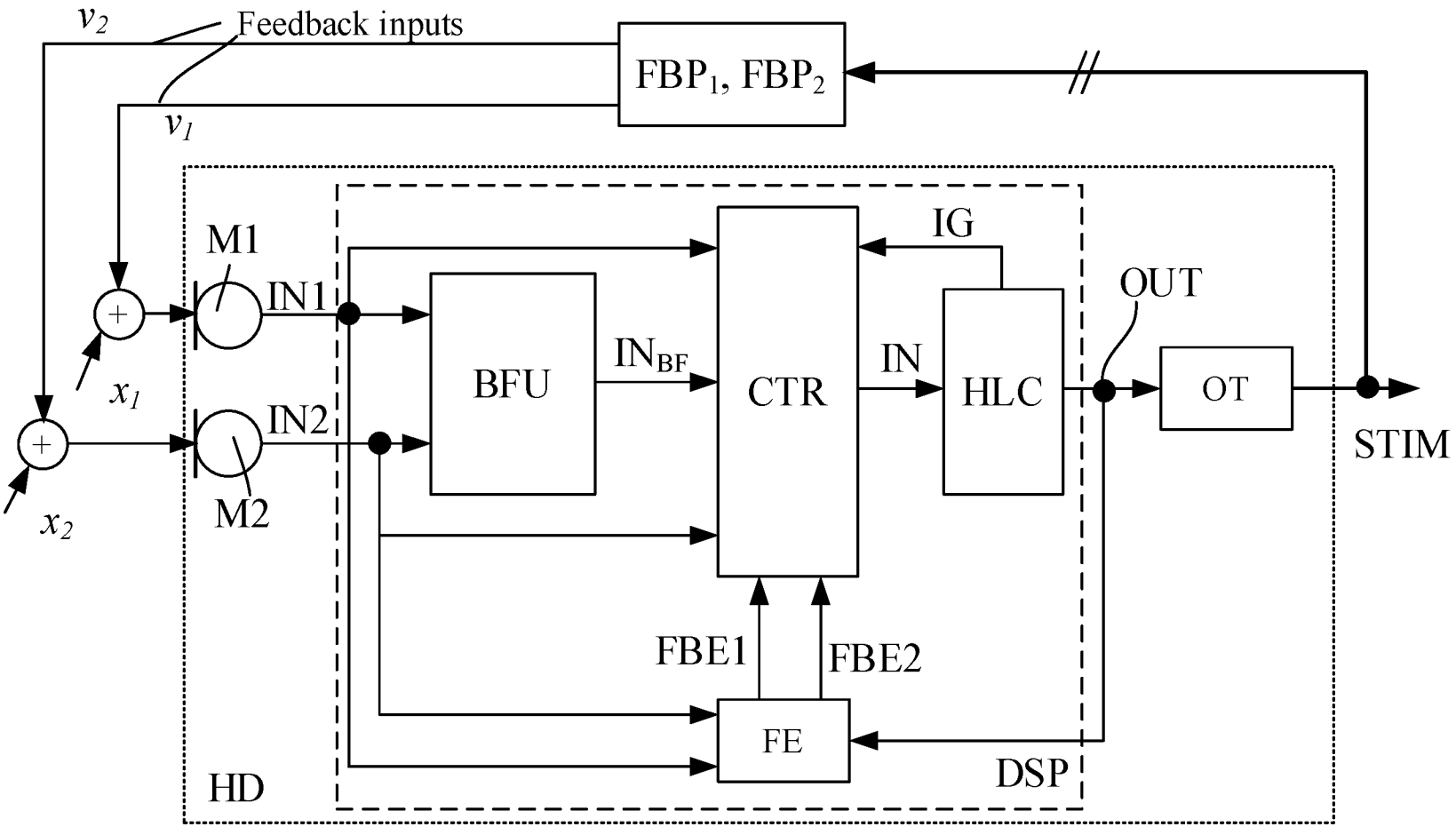
FIG. 1 shows a first embodiment of a hearing aid according to the present disclosure.

Further scope of applicability of the present disclosure will become apparent from the detailed description given hereinafter. However, it should be understood that the detailed description and specific examples, while indicating preferred embodiments of the disclosure, are given by way of illustration only. Other embodiments may become apparent to those skilled in the art from the following detailed description.

DETAILED DESCRIPTION OF EMBODIMENTS

The detailed description set forth below in connection with the appended drawings is intended as a description of various configurations. The detailed description includes specific details for the purpose of providing a thorough understanding of various concepts. However, it will be apparent to those skilled in the art that these concepts may be practiced without these specific details. Several aspects of the apparatus and methods are described by various blocks, functional units, modules, components, circuits, steps, processes, algorithms, etc. (collectively referred to as "elements"). Depending upon particular application, design constraints or other reasons, these elements may be implemented using electronic hardware, computer program, or any combination thereof.

The electronic hardware may include microprocessors, microcontrollers, digital signal processors (DSPs), field programmable gate arrays (FPGAs), programmable logic devices (PLDs), gated logic, discrete hardware circuits, and other suitable hardware configured to perform the various functionality described throughout this disclosure. Computer program shall be construed broadly to mean instructions, instruction sets, code, code segments, program code, programs, subprograms, software modules, applications, software applications, software packages, routines, subroutines, objects, executables, threads of execution, procedures, functions, etc., whether referred to as software, firmware, middleware, microcode, hardware description language, or otherwise.

The present application relates to the field of hearing aids.

A well-known problem in hearing aids is feedback. This relates to a) the internal hardware related (mechanical) feedback that set the limit for full-on-gain (FOG) measured in a 711/2 cc coupler (IEC 711 compliant coupler) used in the datasheet as well as b) acoustic feedback typically observed as a howling tone.

There are various ways of handling the feedback problem using digital signal processing for dynamic feedback cancellation as well as tools in the fitting software to reduce gain (at frequencies prone to feedback for the hearing aid or hearing aid style in question).

Whereas for the hardware related feedback, the design options for hearing aids are typically a choice between A) a reduction in the Full-On Gain (FOG)-parameter B) a selection of new transducers and/or C) improvement of mechanical design.

The Full-On Gain (FOG) parameter limitation is an important feature for controlling the stability of digital hearing aids, by limiting the maximum allowable gain in the hearing aid. The full-on gain limitation is a characteristic of the hardware of the hearing aid and represents the maximum gain that can be applied to the hearing aid without causing mechanical feedback. The determination of the full-on gain is typically performed according to a predefined, e.g. standardized, procedure (e.g. ANSI S3.22-2003: Specification of Hearing Aid Characteristics), e.g. with the gain control of the hearing aid set to its full-on position and with an input sound pressure level (SPL) of 50 dB. Alternatively, the measurement conditions may be indicated in a data sheet of the hearing aid together with the limiting Full-On Gain (FOG) value.

FIG. 1 shows an embodiment of a hearing aid according to the present disclosure. The hearing aid (HD) is adapted to be located at or in an ear of a user and to compensate for a hearing loss of the user. The hearing aid comprises a forward path for processing an input signal representing sound in the environment. The forward path comprises at least two input transducers (e.g. microphones (M1, M2)), each for picking up sound from the environment of the hearing aid and providing respective at least two electric input signals (IN1, IN2). The forward path further comprises a beamformer filter (BFU) for filtering the at least two electric input signals or signals originating therefrom and providing a spatially filtered signal ($IN_{BF}$). The forward path further comprises a signal processor (HLC) for processing one or more of the electric input signals (IN1, IN2) or one or more signals (e.g. the spatially filtered signal $IN_{BF}$) originating therefrom and providing one or more processed signals (OUT) based thereon, and providing one or more processed signals (OUT) based thereon. The forward path further comprises an output transducer (OT, e.g. a loudspeaker) for generating stimuli (STIM, e.g. acoustic stimuli) perceivable by the user as sound based on the one or more processed signals (OUT). The hearing aid (HD) further comprises a feedback estimation system (FE) for estimating a current feedback path ($FBP_1$, $FBP_2$) from the output transducer (OT) to each of the at least two input transducers ($M_1$, $M_2$) and providing respective feedback measures (FBE1, FBE2) indicative thereof. The microphones (M1, M2) each picks up a sound that is a mixture of an 'external sound' from the environment ($x_1$, $x_2$) and a sound ($v_1$, $v_2$) from the output transducer (OT) leaked back to the microphones via respective acoustic feedback paths ($FBP_1$, $FBP_2$) (cf. acoustic sum unit '+' to the left of the respective microphones (M1, M2) in FIG. 1). The hearing aid further comprises a controller (CTR) configured to receive the feedback measures (FBE1, FBE2) from the feedback estimation system (FE) and the electric input signals (IN1, IN2) and the beamformed signal ($IN_{BF}$), and possibly a requested gain (or insertion gain, IG) from the signal processor (HLC). The hearing aid may comprise a loop gain estimator for estimating a current loop gain. Using a current estimate of a feedback path from the output transducer to the microphone(s), and knowledge of the currently requested gain to compensate for a hearing impairment of the user, the fulfilment of a specific feedback criterion for entering a critical feedback mode of operation may be checked (e.g. enter critical feedback mode, if LG~FBE+IG≥0 dB). In the critical feedback mode, the controller (CTR) may be configured to select the electric input signal (IN1; IN2) from the input transducer among the at least two input transducers (M1, M2) having the smallest feedback measure (or gain margin) as the input signal (IN) to the signal processor (HLC), in case a feedback path difference measure determined by comparison of at least two of said feedback measures is larger than a first threshold value $FBDM_{TH1}$ (e.g. $FBDM_{12}$=FBE1−FBE2>$FBDM_{TH1}$). In the critical feedback mode, the controller (CTR) may further be configured to select the spatially filtered signal ($IN_{BF}$) as the input signal (IN) to the signal processor (HLC), in case all of the feedback path difference measures determined by comparison of each of said feedback measures is(are) smaller than a second threshold value $FBDM_{TH2}$ (e.g. $FBDM_{12}$=FBE1−FBE2<$FBDM_{TH2}$). In an embodiment, $FBDM_{TH1}$=$FBDM_{TH2}$. In an embodiment, $FBDM_{TH1}$≥$FBDM_{TH2}$. The (fully) 'digital components' of the hearing aid (e.g. other components than the input and output transducers) are enclosed by the dashed outline and denoted (DSP), cf. e.g. also digital signal processor (DSP) of FIG. 3A.

Figure 2A:
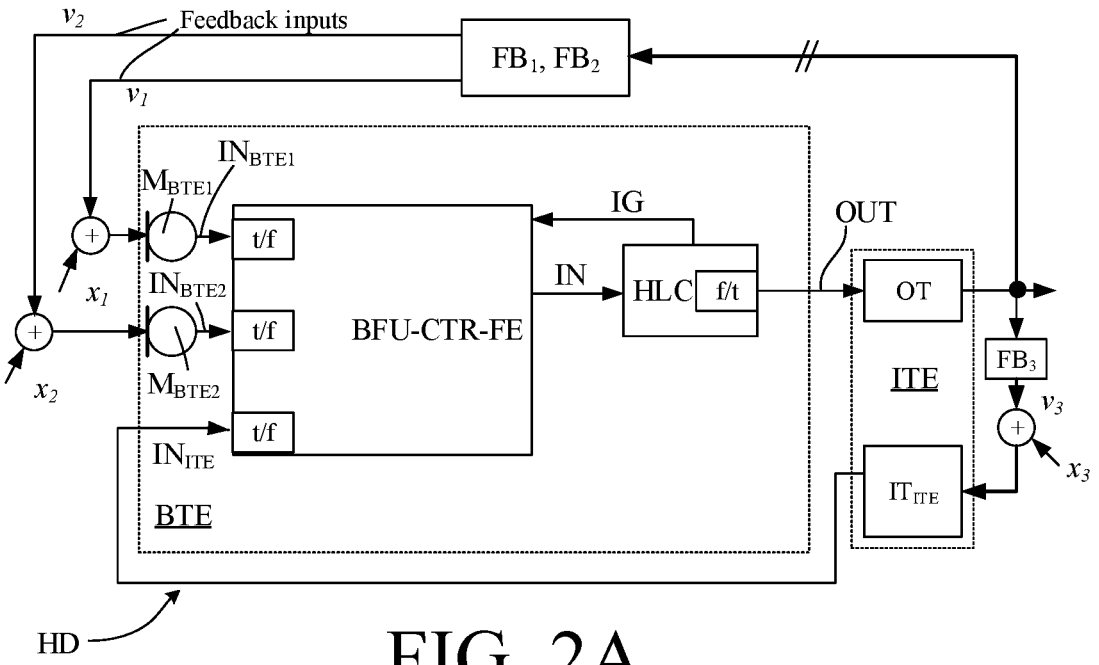
FIG. 2A shows a second embodiment of a hearing aid according to the present disclosure.

FIG. 2A shows an embodiment of a hearing aid (HD) according to the present disclosure similar to the embodiment of FIG. 1. In the embodiment of FIG. 2A, however, the hearing aid (HD) is partitioned in a BTE-part and an ITE-part. The BTE-part (BTE) is e.g. adapted to be located at or behind an ear (pinna) of the user. The ITE-part (ITE) is e.g. adapted to be located at or in an ear canal of the user. The hearing aid (HD) may be of a particular style sometimes termed 'receiver-in-the-ear' (RITE), because the ITE-part comprises the loudspeaker (OT, often termed 'receiver' in the field of hearing aids). The embodiment of FIG. 2A comprises three input transducers, two microphones ($M_{BTE1}$, $M_{BTE2}$) located in the BTE-part and one further input transducer ($IT_{ITE}$, e.g. a microphone, an accelerometer, or the like to pick up vibrations) located in the ITE-part. The BTE and ITE-parts are electrically connected by conductors for connecting the signal processor (HLC) to the output transducer (OT) and input transducer ($IT_{ITE}$) to the beamformer filter (BFU), and for providing power (at least) to the input transducer. The third input transducer ($IT_{ITE}$) located in the ITE-part receives an external sound (or vibration) $x_3$ mixed with a feedback signal $v_3$ from the output transducer (OT) via feedback path $FB_3$. The BTE-part comprises, in addition to the two microphones ($M_{BTE1}$, $M_{BTE2}$) and the electric input from the input transducer ($IT_{ITE}$) located in the ITE-part, the beamformer filter (BFU), the feedback estimation system (FE), the controller (CTR) and the signal processor (HLC) as described in connection with FIG. 1. The three functional units, BFU, CTR, and FE, are shown as one unit (enclosed in box denoted BFU-CTR-FE) in FIG. 2A. Additionally, each of the three (time domain) inputs ($IN_{BTE1}$, $IN_{BTE2}$, $IN_{ITE}$) from the respective input transducers ($M_{BTE1}$, $M_{BTE2}$, $IT_{ITE}$) to the beamformer filter (BFU) comprises respective analysis filter banks (t/f) for providing the time domain signals as frequency sub-band signals for being individually processed in the forward path of the hearing aid (here the BTE-part) Similarly, the output path (OUT) comprises a synthesis filter bank (f/t) for converting frequency sub-band signals to a time-domain signal (OUT), which is forwarded to the output transducer (OT, e.g. a loudspeaker, in the ITE-part) via an electric cable of a connecting element. The presence of three input transducers provides an improved possibility of making an appropriate beamforming e.g. including directing a beam towards the user's mouth (e.g. in a telephone situation or the like). The different location of the three input transducers provides an improved possibility to identify an input transducer with a relatively low feedback path (high gain margin) in many acoustic situations. In an embodiment, a directional signal (IN') based on the two BTE-microphone signals $IN_{BTE1}$ and $IN_{BTE2}$, or feedback corrected versions (ERR1 and ERR2) thereof, may be used as a first microphone signal and the input signal $IN_{ITE}$ from the ITE-microphone ($IT_{ITE}$), or feedback corrected version (ERR3) thereof, may be used as a second microphone signal. The scheme according to the present disclosure may be used to—in a specific critical feedback mode of operation—select between the beamformed signal (IN') based on the BTE-microphone signals and the beamformed signal (IN) based on all three input signals in dependence of a predetermined feedback criterion.

Figure 2B:
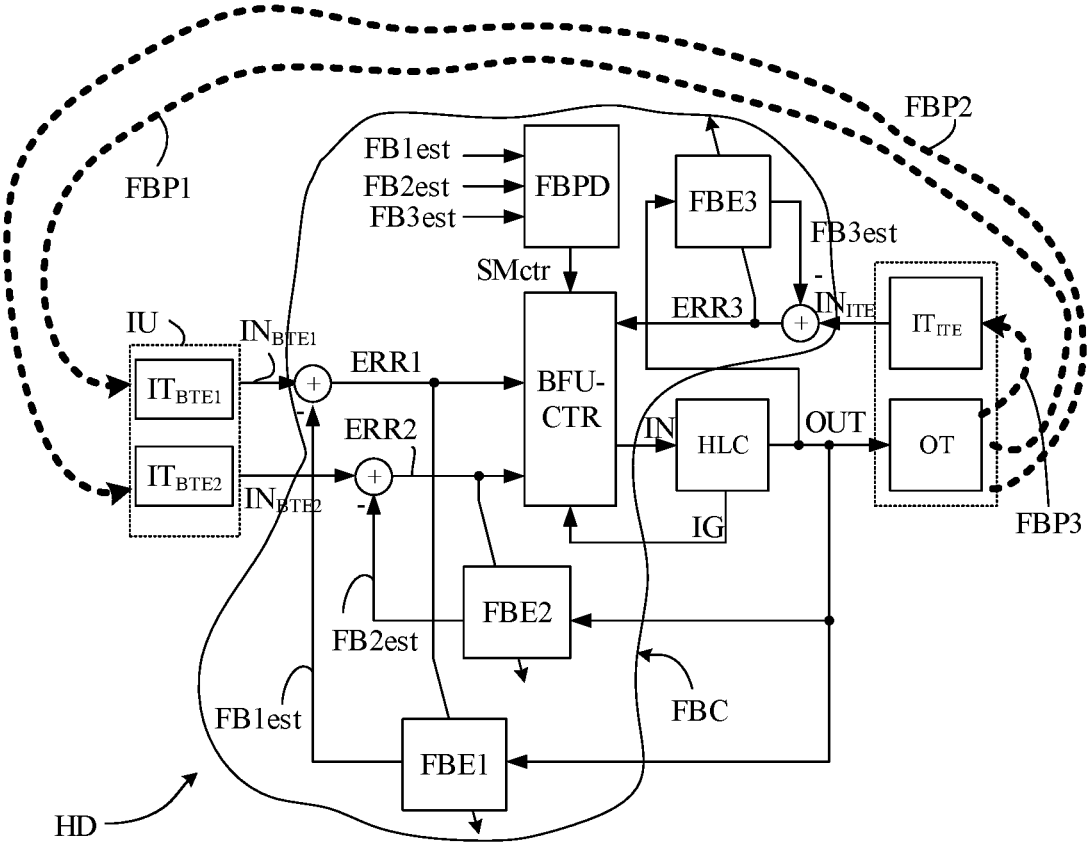
FIG. 2B shows a third embodiment of a hearing aid according to the present disclosure.

FIG. 2B shows an embodiment of a hearing aid (HD) according to the present disclosure similar to the embodiment illustrated in FIGS. 1 and 2A. A difference is that the embodiment of FIG. 2B further comprises a feedback control system (denoted FBC in FIG. 2B (curved solid line enclosure)) comprising respective adaptive filters (FBE1, FBE2, FBE3) and combination units ('+') (and here also including the beamformer control unit (BFU-CTR); the latter may in other embodiments be excluded from the feedback control system). The three adaptive filters (FBE1, FBE2, FBE3, respectively) are configured to adaptively estimate the three feedback paths (FBP1, FBP2, FBP3, respectively) from the output transducer (OT) to the three input transducers ($IT_{BTE1}$, $IT_{BTE2}$, $IT_{ITE}$, respectively). The three subtraction units ('+') are configured to subtract the three feedback path estimates (FB1*est*, FB2*est*, FB3*est*, respectively) from the electric input signals ($IN_{BTE1}$, $IN_{BTE2}$, $IN_{ITE}$, respectively) and to provide respective feedback corrected input signals (ERR1, ERR2, ERR3). The feedback corrected input signals (ERR1, ERR2, ERR3) are fed to the beamformer-control unit (BFU-CTR). The feedback path estimates (FB1*est*, FB2*est*, FB3*est*) are fed to a feedback path difference measure unit (FBPD) configured to determine respective feedback path difference measures (here e.g. $FBDM_{12}$=FB1*est*−FB2*est*, $FBDM_{13}$=FB1*est*−FB3*est*, and $FBDM_{23}$=FB2*est*−FB3*est*) and to provide a selection-control signal SMctr in dependence thereof (e.g. according to a predefined criterion). The selection control signal SMctr is fed to the beamformer-control unit (BFU-CTR) (possibly together with requested gain (IG) from the signal processor (HLC)) for selecting one of the feedback corrected input signals (ERR1, ERR2, ERR3) or a beamformed signal provided as a combination of the three feedback corrected input signals (cf. e.g. $IN_{BF}$ in FIG. 1). Based thereon, the beamformer-control unit (BFU-CTR) provides a resulting signal (IN) for further processing (e.g. according to the hearing aid user's needs) in the processor (HLC), and presentation to the user. The beamformer filtering unit may e.g. comprise a beamformer algorithm of a generalized sidelobe canceller (GSC) type, e.g. a minimum variance distortionless response (MVDR) type beamformer algorithm. The beamformer filtering unit may e.g. provide a non-linear combination of the input signals, e.g. implemented by a trained neural network.

Figure 3A:
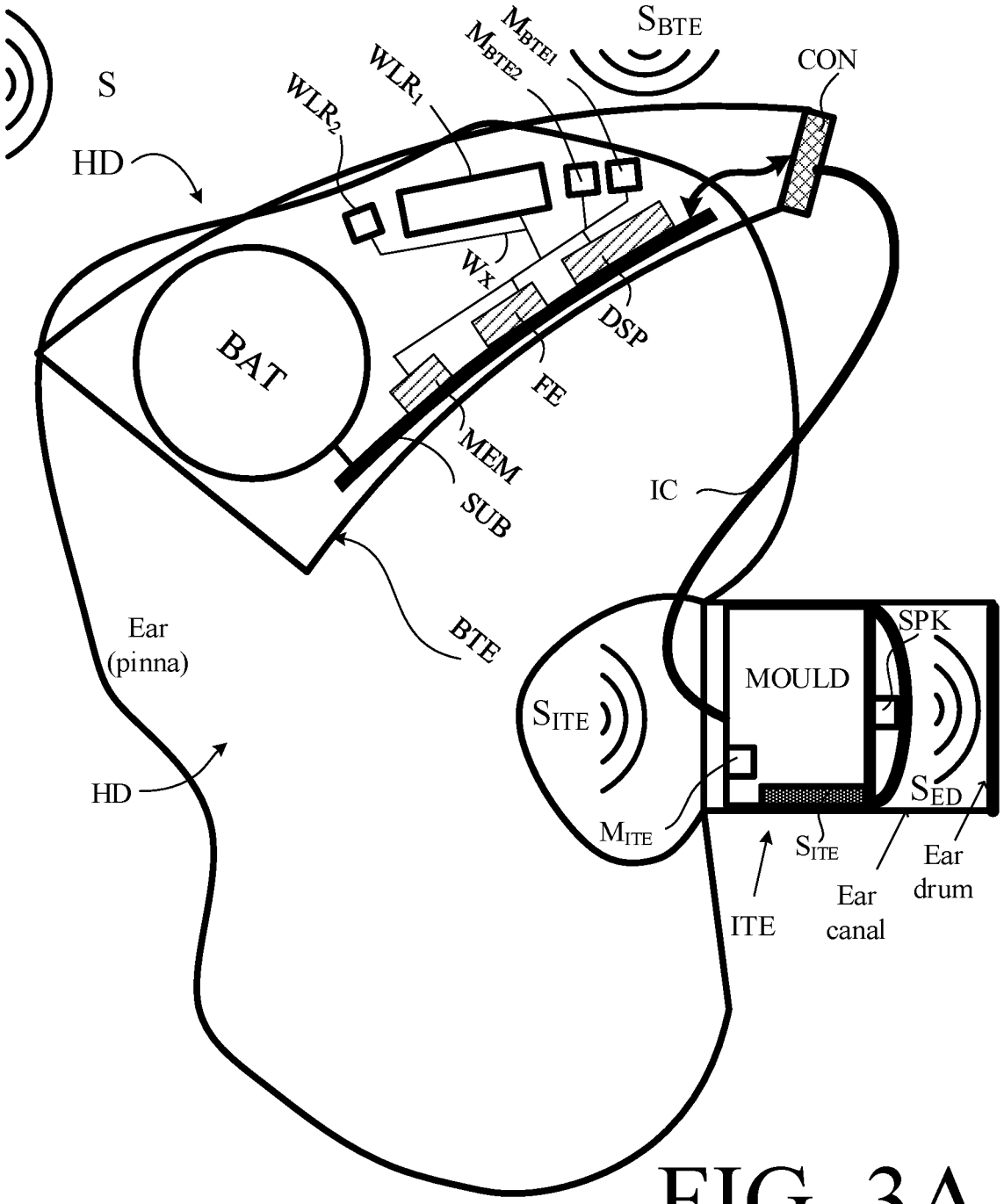
FIG. 3A shows a fourth embodiment of a hearing aid according to the present disclosure.

FIG. 3A shows an embodiment of a BTE-style hearing aid according to the present disclosure. The hearing aid is partitioned in a BTE-part adapted to be located at or behind the ear ((Ear (pinna)) and an ITE-part adapted to be located at or in the ear canal (Ear canal) of the user, as described in connection with FIG. 2A, 2B. As appears from FIG. 3A, the BTE-part comprises two microphones ($M_{BTE1}$, and $M_{BTE2}$) and the ITE-part comprises one microphone ($M_{ITE}$). The ITE-part comprises an ear mould (MOULD) constituting a housing, wherein the microphone (MITE) and the loudspeaker (SPK) are located. The ear mould is e.g. adapted to the user's ear canal to minimize leakage of sound from the loudspeaker (SPK) of the hearing aid to the environment (and from the environment to the ear drum). The ear mould may comprise a vent to allow pressure to be aligned between the environment and the residual volume between the mould and the ear drum (to minimize occlusion). The ear mould (MOULD) may comprise a sensor (SITE) located near the surface of the housing allowing a contact or interaction with tissue of the ear canal. The sensor may e.g. be an electric potential sensor (e.g. to pick up signals from the brain (e.g. EEG) or and/from the eye balls (e.g. EOG) or from muscle contractions (e.g. jaw movements), or a movement sensor, e.g. to pick up vibrations of the skin or bone (e.g. to detect when the user speaks ('own voice')), or an EPF-sensor to pick up light reflections from the ear canal, or a temperature sensor for estimating a temperature, or a photoplethysmogram (PPG) sensor for estimating various properties of the user's body (e.g. heart rate), etc.

The three microphone signals ($IN_{BTE1}$, $IN_{BTE2}$, $IN_{ITE}$, cf. FIG. 2A, 2B) are routed to a beamformer filter (BFU) and used for providing one or more beamformed signals $Y_{BF}$ for further processing in the signal processor (DSP) comprising a controller (CTR) and processor (HLC) according to the present disclosure as e.g. described in connection with FIG. 1, 2A, 2B. The signal(s) from one or more sensors SITE is/are routed to the signal processor (DSP) for being considered there, (e.g. for being processed and/or transmitted to another device, e.g. to a user interface for processing and/or presentation there). One or more other sensors connected to the hearing aid may be located in the BTE-part or elsewhere at or around the ear of the user (or implanted in the head or body of the user).

The hearing aid (HD), e.g. the BTE-part and/or the ITE-part, may comprise a (wireless or wired) programming interface and possibly a (wireless or wired) user communication interface. The programming interface (allowing connection to a programming device, e.g. a fitting system) and the user communication interface may be implemented using one or both wireless transceivers (WLR1, WLR2) shown in FIG. 3A to be located in the BTE-part. Alternatively, the interfaces may be implemented as wired connections, e.g. via a connector.

The connecting element (IC) between the BTE-part and the ITE-part is shown as a cable comprising electric conductors for electrically connecting electronic components (and battery (BAT)) of the BTE- and ITE-parts. The connecting element comprises a connector to the BTE-part allowing the ITE-part (and the connecting element) to be easily detached and attached to the BTE-part (and e.g. to be exchanged with another one, e.g. comprising a different loudspeaker or a different sensor or sensors, or no microphone or more than one microphone, etc.). The connecting element (IC) between the BTE-part and the ITE-part may comprise an acoustic tube, in case the loudspeaker is located in the BTE-part instead of in the ITE-part.

The BTE-part comprises a substrate (SUB) comprising electronic components (memory (MEM), a FrontEnd-IC (FE), and a digital signal processor IC/DSP) and appropriate wiring (Wx) for mutually connecting the electronic components on the substrate and to the battery (BAT), to the wireless transceivers ($WLR_1$, $WLR_2$), to the microphones ($M_{BTE1}$, $M_{BTE2}$, $M_{ITE}$) to the sensor(s) (SITE), to the loudspeaker (SPK), and to possible other components of the BTE- and ITE-parts. The memory (MEM) may store appropriate settings for the hearing aid, e.g. different hearing aid programs and customized parameters. The FrontEnd IC (FE) is an integrated circuit handling interfaces to mainly analogue components, such as microphones and loudspeaker, and possibly sensors, etc. The digital signal processor (DSP) comprises digital components of the hearing aid, including the beamformer filter (BFU), the controller (CTR), processor (HLC), etc., as described in connection with FIG. 1, 2A, 2B.

The microphones of the hearing aid are configured to pick up respective sound elements ($S_{BTE}$ at the BTE-microphones ($M_{BTE1}$, $M_{BTE2}$) and SITE at the ITE-microphone ($M_{ITE}$)) of a sound field (S) around the hearing aid (HD) (i.e. around a user wearing the hearing aid). A sound field ($S_{ED}$) at the ear drum (Ear drum) of the user wearing the hearing aid is a result of the sound produced by the loudspeaker (SPK) and sound leaked into the ear canal from the environment (e.g. through a vent or other openings) of the ITE-part of the hearing aid. The sound delivered by the loudspeaker is determined according to the present disclosure based on the user's hearing ability (e.g. hearing loss, i.e. corresponding to an appropriate gain applied by the hearing aid), the sound fields ($S_{BTE}$, SITE) picked up by the microphones, and the current feedback estimates from the loudspeaker (SPK) to the respective microphones ($M_{BTE1}$, $M_{BTE2}$, and $M_{ITE}$).

Figure 3B:
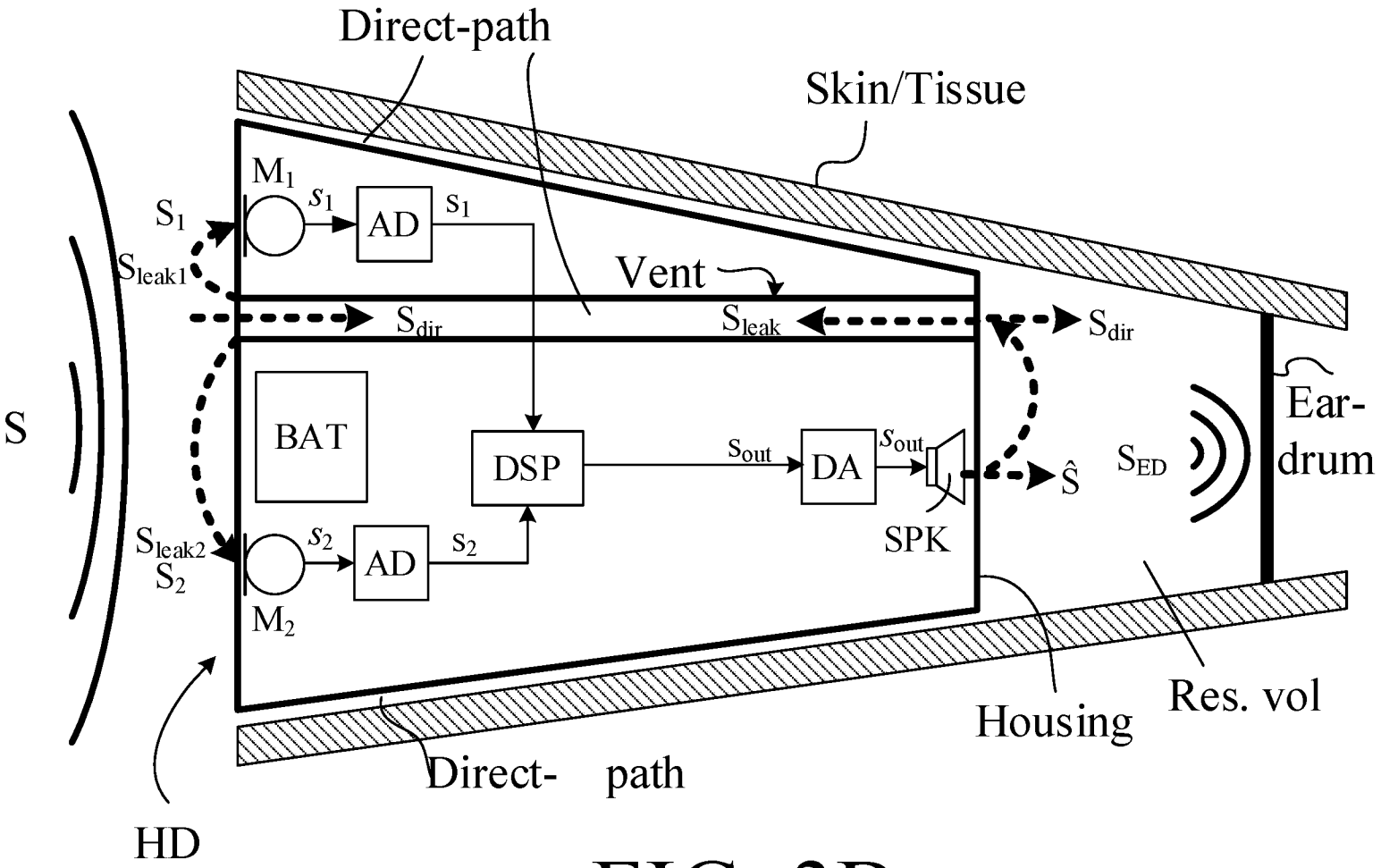
FIG. 3B shows a fifth embodiment of a hearing aid according to the present disclosure, and FIG. 4A schematically shows a mechanical feedback measure (M-FB) versus frequency curve for a hearing aid, illustrating the parameter full-on gain (FOG), and FIG. 4B schematically illustrates exemplary first and second feedback measures (FBM) versus frequency.

FIG. 3B shows a further embodiment of a hearing aid (HD) according to the present disclosure. FIG. 3B schematically illustrates an ITE-style hearing aid according to an embodiment of the present disclosure. The hearing aid (HD) comprises or consists of an ITE-part comprising a housing (Housing), which may be a standard housing aimed at fitting a group of users, or it may be customized to a user's ear (e.g. as an ear mould, e.g. to provide an appropriate fitting to the outer ear and/or the ear canal). The housing schematically illustrated in FIG. 3B has a symmetric form, e.g. around a longitudinal axis from the environment towards the ear drum (Eardrum) of the user (when mounted), but this need not be the case. It may be customized to the form of a particular user's ear canal. The hearing aid may be configured to be located in the outer part of the ear canal, e.g. partially visible from the outside, or it may be configured to be located completely in the ear canal, possibly deep in the ear canal, e.g. fully or partially in the bony part of the ear canal.

To minimize leakage of sound (played by the hearing aid towards the ear drum of the user) from the ear canal, a good mechanical contact between the housing of the hearing aid and the Skin/tissue of the ear canal is aimed at. In an attempt to minimize such leakage, the housing of the ITE-part may be customized to the ear of a particular user.

The hearing aid (HD) comprises a number Q of microphones $M_q$, i=1, . . . , Q, here two (Q=2). The two microphones ($M_1$, $M_2$) are located in the housing with a predefined distance d between them, e.g. 8-10 mm, e.g. on a part of the surface of the housing that faces the environment when the hearing aid is operationally mounted in or at the ear of the user. The microphones ($M_1$, $M_2$) are e.g. located on the housing to have their microphone axis (an axis through the centre of the two microphones) point in a forward direction relative to the user, e.g. a look direction of the user (as e.g. defined by the nose of the user, e.g. substantially in a horizontal plane), when the hearing aid is mounted in or at the ear of the user. Thereby the two microphones are well suited to create a directional signal towards the front (and or back) of the user. The microphones are configured to convert sound ($S_1$, $S_2$) received from a sound field S around the user at their respective locations to respective (analogue) electric signals ($s_1$, $s_2$) representing the sound. The microphones are coupled to respective analogue to digital converters (AD) to provide the respective (analogue) electric signals (s1, s2) as digitized signals (s1, s2). The digitized signals may further be coupled to respective filter banks to provide each of the electric input signals (time domain signals) as frequency sub-band signals (frequency domain signals). The (digitized) electric input signals ($s_1$, $s_2$) are fed to a digital signal processor (DSP) for processing the audio signals ($s_1$, $s_2$), e.g. including one or more of spatial filtering (beamforming), (e.g. single channel) noise reduction, compression (frequency and level dependent amplification/attenuation according to a user's needs, e.g. hearing impairment), spatial cue preservation/restoration, etc. The digital signal processor (DSP) may e.g. comprise the appropriate filter banks (e.g. analysis as well as synthesis filter banks) to allow processing in the frequency domain (individual processing of frequency sub-band signals). The digital signal processor (DSP) is configured to provide a processed signal $s_{out}$ comprising a representation of the sound field S (e.g. including an estimate of a target signal therein). The processed signal $s_{out}$ is fed to an output transducer (here a loudspeaker (SPK), e.g. via a digital to analogue converter (DA), for conversion of a processed (digital electric) signal $s_{out}$ (or analogue version $s_{out}$) to a sound signal $S_{out}$. In a mode of operation according to the present disclosure (in dependence of the current feedback path estimates), the hearing aid is configured to use A) either a spatially filtered signal (from a beamformer filter, cf. e.g. $IN_{BF}$ and BFU in FIG. 1), or B) a specific one of the electric input signals ($s_1$, $s_2$) (or a processed, e.g. feedback corrected, version thereof), to be processed by the processor (e.g. according to the user's needs) and presented to the user via the loudspeaker (SPK) (possibly via the DA-converter (DA)).

The hearing aid (HD) may e.g. comprise a venting channel (Vent) configured to minimize the effect of occlusion (when the user speaks). In addition to allowing an (unintended) acoustic propagation path $S_{leak}$ from a residual volume (cf. Res. Vol in FIG. 3B) between a hearing aid housing and the ear drum to be established, the venting channel also provides a direct acoustic propagation path of sound from the environment to the residual volume. The directly propagated sound San reaching the residual volume is mixed with the acoustic output of the hearing aid (HD) to create a resulting sound $S_{ED}$ at the ear drum. In a mode of operation, active noise suppression (ANS) is activated in an attempt to cancel out the directly propagated sound San.

The hearing aid (HD) comprises a forward path comprising two (or more transducer(s)), here two microphone(s) ($M_1$, $M_2$), appropriate AD-converters (AD), the digital signal processor (DSP), e.g. comprising appropriate analysis and synthesis filter banks, as the case may be, and one or more processing algorithms for enhancing the input audio signal(s) ($s_1$, $s_2$) to provide a processed signal $s_{out}$, possibly a digital to analogue converter (DA), and the output transducer, here loudspeaker (SPK). The forward path is configured to pick up external sound, process the sound and provide a processed version of the sound ($S_{out}$) to the user, e.g. the user's ear drum. In addition to the external sound ($S_1$, $S_2$), the microphones ($M_1$, $M_2$) also receive (and pick up) sound ($S_{leak1}$, $S_{leak2}$) leaked from the output transducer (SPK) of the hearing aid e.g. via the vent (Vent) and/or other leakage paths (denoted 'Direct-path' in FIG. 3B) from the residual volume (Res. vol) at the ear drum to the respective microphones ($M_1$, $M_2$). The leakage paths represented by leaked sound ($S_{leak1}$, $S_{leak2}$) are estimated by the hearing aid via a feedback estimation unit (FE), cf. e.g. FIG. 1, and the resulting estimates (cf. e.g. FBE1, FBE2) are used to control which of the input signals ($s_1$ or $s_2$) or the beamformed signal formed as a combination of the electric input signals ($s_1$, $s_2$) according to the present disclosure, as e.g. described in connection with FIG. 1, is further processed and presented to the user at a given point in time. The ventilation channel (Vent) is asymmetrically located in the hearing aid housing (Housing). Such asymmetric location may be a result of a design constraint due to components of the hearing aid, e.g. a battery. Thereby the first and second microphones ($M_1$, $M_2$) have different feedback paths from the loudspeaker (SPK). The first microphone ($M_1$) is located closer to the ventilation channel than the second microphone ($M_2$). Other things being equal, the feedback measure (FBM1) of the first microphone is larger than the feedback measure (FBM2) of the second microphone, at least above a minimum frequency, see e.g. FIG. 4B. The scheme according to the present disclosure for controlling (e.g. to switch, such as fade, between) the use of either a beamformed signal or the signal from a single one of the input transducers in the forward path of the hearing aid may be applied to the ITE-hearing aid of FIG. 3B to allow more flexibility as regards the location of the input transducers and the ventilation channel relative to each other without compromising (decreasing) the full-on gain value of the hearing aid. When the microphone system of the hearing aid is in a DIR-mode (where the beamformed signal is used for amplification and presentation to the user) and when feedback to one of the microphones (or a feedback path difference measure for the two microphones) increases above a threshold level, the mode of the microphone system is changed to an OMNI-mode. In the OMNI-mode, the signal from the (single) microphone having the lowest feedback is used for amplification and presentation to the user. Thereby feedback howl at the current level of feedback can be avoided.

The hearing aid comprises an energy source, e.g. a battery (BAT), e.g. a rechargeable battery, for energizing the components of the device.

Figure 4A:
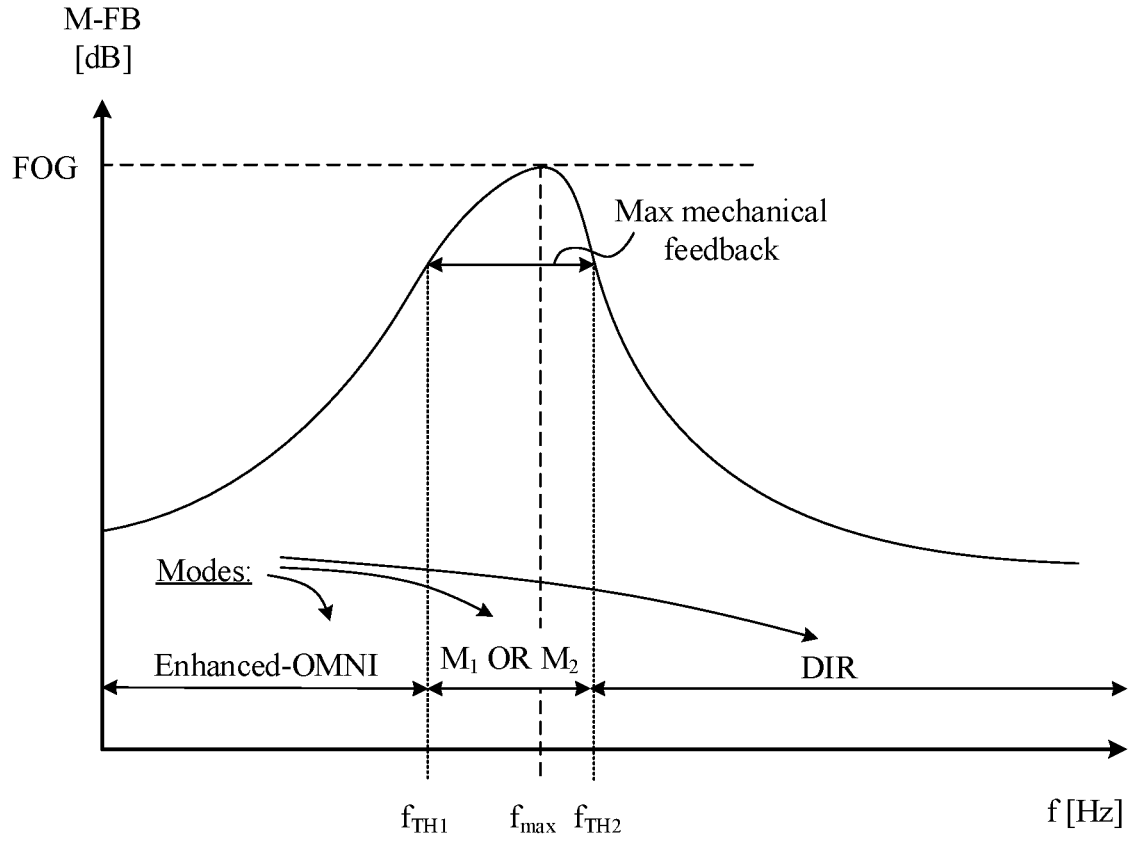
Figure 4B:
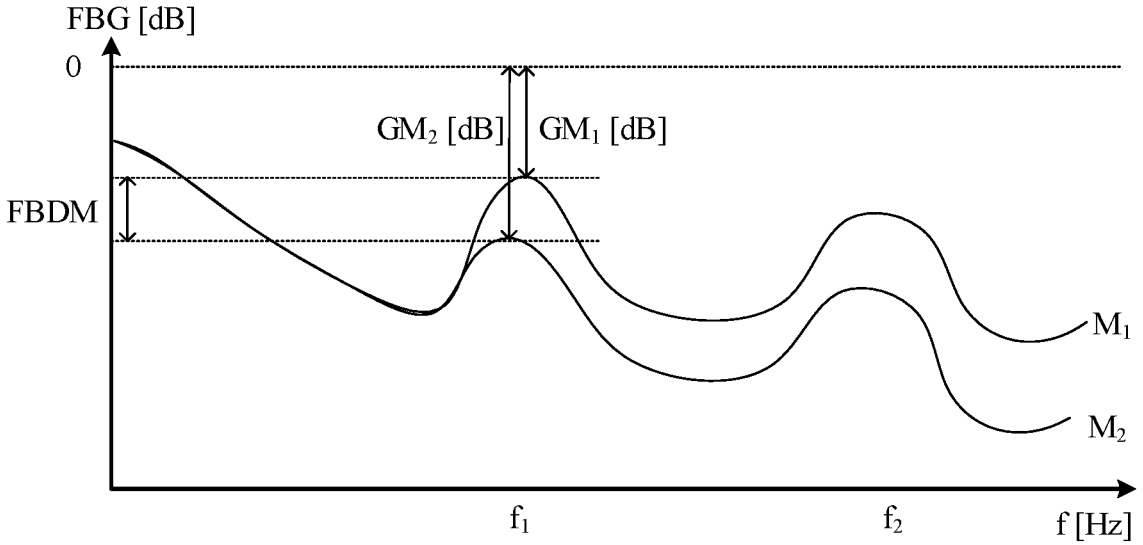

FIG. 4A shows a mechanical feedback measure (M-FB) versus frequency curve for a hearing aid, illustrating the parameter full-on gain (FOG), and FIG. 4B schematically illustrates exemplary first and second feedback measures (FBM) versus frequency.

FIG. 4A illustrates how a (mechanical) feedback measure, M-FB [dB], varies over frequency, f [Hz], (possibly on a logarithmic scale) at full-on gain conditions (e.g. ANSI S3.22-2003: Specification of Hearing Aid Characteristics) and that a specific frequency range (between first and second threshold frequencies $f_{TH1}$, $f_{TH2}$) determine the maximum full-on gain (FOG). The maximum full-on gain for a super- or ultra-power, BTE-type hearing aid (e.g. FIG. 3A) may e.g. be in a range between 60 dB and 90 dB, e.g. ≤87 dB, and between 40 dB and 70 dB for a corresponding ITE-type hearing aid (e.g. FIG. 3B). The specific frequency range determining maximum allowable FOG (i.e. exhibits maximum mechanical feedback) is dependent on the specific hardware construction, but may for a typical BTE-super-power hearing aid lie in a range between 800-1000 Hz, e.g. having a maximum feedback at 900 Hz, and for a corresponding ITE hearing aid around 3 kHz (as indicated in FIG. 4A by '$f_{max}$'). FIG. 4A illustrates exemplary modes of operation (cf. reference 'Modes' and three arrows pointing towards three frequency ranges, and three different modes of operation) of a hearing aid according to the present disclosure (e.g. as indicated in FIG. 3B). At low frequencies (below Gm), the directional system (cf. e.g. BFU in FIG. 1) of the hearing aid is in an omni-directional mode (denoted 'Enhanced omni in FIG. 4A, e.g. implemented by a delay and sum beamformer (or the like)), so in the frequency bands covering this range, the resulting beamformed signal is used for further processing (amplification, etc.) in the processor (HLC, in FIG. 1). At high frequencies (above $f_{TH2}$), the directional system of the hearing aid is in a directional mode, e.g. implemented by a delay and subtract beamformer (or the like), so in the frequency bands covering this range, the resulting beamformed signal is used for further processing in the processor (HLC, in FIG. 1). In the frequency bands covering the intermediate frequency range (above $f_{TH1}$ and below $f_{TH2}$), one of the input signals (e.g. IN1 or IN2 in FIG. 1, or $s_1$ or $s_2$ in FIG. 3B) is selected for further processing in the processor (so the beamformed signal is not used in the intermediate range).

FIG. 4B illustrates an example of different (acoustic) feedback paths from the output transducer to the respective (first and second) input transducers, as e.g. illustrated by $M_1$ and $M_2$ of FIG. 3B. The feedback path is represented by feedback gain (attenuation, e.g. expressed by negative gain values in dB), FBG [dB], versus frequency, f [Hz] (e.g. in a logarithmic scale, or as FBG-values at preselected discrete frequencies). The feedback gain for a hearing aid depends of the style, including the relative positions of microphones and loudspeaker. In a (very) general sense feedback typically decreases with increasing frequency from around 1 kHz to 10 kHz. A number of large peaks and valleys providing local deviations from this trend may, however, be experienced in this frequency range. The schematic course of the two FBG-curves of FIG. 4B indicate this general trend.

The first feedback measure ($FBM_1$), here feedback gain FBG, for the first microphone ($M_1$) is generally larger (less negative) than the second feedback measure ($FBM_2$) for the second microphone ($M_2$). A feedback path difference measure $FBDM_{12}$ may be defined as a difference between the first and second feedback measures (e.g. feedback path estimates), $FBDM_{12}=FBM_1-FBM_2$. The feedback path difference measure $FBDM_{12}$ may be defined at a number of specific frequencies, e.g. at centre frequencies of all (or selected) frequency bands, or in limited number of frequency bands, e.g. 500 Hz, 1 kHz, 2 kHz, 4 kHz, 8 kHz. A distance measure, FBDM, defined by values at one or more of these frequencies may—in a specific critical feedback mode of operation, e.g. where a specific feedback criterion (e.g. loop gain$\leq LG_{max}$) is fulfilled—be used to control (determine a selection of) the input signals to the hearing aid processor according to the present disclosure. In the example of FIG. 4B, the smallest gain margin GM ($GM_1$, $GM_2$) (e.g. of the order of 10-20 dB) for the two microphones ($M_1$, $M_2$) are indicated at around frequency $f_1$, e.g. corresponding to maximum feedback gains of −12 dB and −20 dB, respectively.

As discussed in connection with FIG. 4A, the hearing aid may be in different modes of operation in different frequency bands (or ranges) depending on the value of the feedback path difference measure(s) in each frequency band (or range). The (resulting) feedback path difference measure (FBDM(Δf)) of a given frequency range Δf may e.g. be determined as an average (e.g. a weighted average) of individual feedback path difference measures at frequencies of the range in question. The first and second feedback measures or the (resulting) feedback path difference measure may (e.g. furthermore) be averaged over a certain time, e.g. of the order of seconds.

It is intended that the structural features of the devices described above, either in the detailed description and/or in the claims, may be combined with steps of the method, when appropriately substituted by a corresponding process.

As used, the singular forms "a," "an," and "the" are intended to include the plural forms as well (i.e. to have the meaning "at least one"), unless expressly stated otherwise. It will be further understood that the terms "includes," "comprises," "including," and/or "comprising," when used in this specification, specify the presence of stated features, integers, steps, operations, elements, and/or components, but do not preclude the presence or addition of one or more other features, integers, steps, operations, elements, components, and/or groups thereof. It will also be understood that when an element is referred to as being "connected" or "coupled" to another element, it can be directly connected or coupled to the other element, but intervening elements may also be present, unless expressly stated otherwise. Furthermore, "connected" or "coupled" as used herein may include wirelessly connected or coupled. As used herein, the term "and/or" includes any and all combinations of one or more of the associated listed items. The steps of any disclosed method is not limited to the exact order stated herein, unless expressly stated otherwise.

It should be appreciated that reference throughout this specification to "one embodiment" or "an embodiment" or "an aspect" or features included as "may" means that a particular feature, structure or characteristic described in connection with the embodiment is included in at least one embodiment of the disclosure. Furthermore, the particular features, structures or characteristics may be combined as suitable in one or more embodiments of the disclosure. The previous description is provided to enable any person skilled in the art to practice the various aspects described herein. Various modifications to these aspects will be readily apparent to those skilled in the art, and the generic principles defined herein may be applied to other aspects.

The claims are not intended to be limited to the aspects shown herein, but is to be accorded the full scope consistent with the language of the claims, wherein reference to an element in the singular is not intended to mean "one and only one" unless specifically so stated, but rather "one or more." Unless specifically stated otherwise, the term "some" refers to one or more.

Accordingly, the scope should be judged in terms of the claims that follow.

REFERENCES

EP3185589A1 (Oticon) 28 Jun. 2017.

[Brandstein & Ward; 2001] M. Brandstein and D. Ward, "Microphone Arrays", Springer 2001.

EP3229490A1 (Oticon) 11 Oct. 2017.

EP3185588A1 (Oticon) 28 Jun. 2017.

The invention claimed is:

1. A hearing aid adapted to be located at or in an ear of a user and to compensate for a hearing loss of the user, the hearing aid comprising a forward path comprising at least two input transducers, each for picking up sound from an environment of the hearing aid and providing respective at least two electric input signals;

a beamformer filter for filtering said at least two electric input signals or signals originating therefrom and providing a spatially filtered signal;

a signal processor for processing one or more of said electric input signals or one or more signals originating therefrom, and providing one or more processed signals based thereon, and an output transducer for generating stimuli perceivable by the user as sound based on said one or more processed signals;

a feedback estimation system for estimating a current feedback from the output transducer to each of the at least two input transducers and providing respective feedback measures indicative thereof; and a controller configured to receive said feedback measures from said feedback estimation system and to switch between two modes of operation of the hearing aid, a one-input transducer mode of operation, and a multi-input transducer mode of operation, in dependence of the feedback measures, wherein the hearing aid comprises an ITE-part adapted for being located at or in an ear canal of the user and the ITE-part comprises said at least two input transducers and said output transducer.

2. A hearing aid according to claim 1 wherein the controller is configured to switch to the one-input transducer mode of operation in case a current feedback path difference measure between two of said feedback measures is larger than a first threshold value, and to select the electric input signal from the input transducer among the at least two input transducers having the smallest feedback measure, or a signal originating therefrom, as the input signal to the signal processor.

3. A hearing aid according to claim 1 wherein the controller is configured to switch to the multi-input transducer mode of operation in case a feedback path difference measure between each of said feedback measures is smaller than a second threshold value, and to select the spatially filtered signal as the input signal to the signal processor.

4. A hearing aid according to claim 1 wherein said feedback measure for a given input transducer comprises an impulse response of the feedback path from the output transducer to the input transducer in question, or a frequency response of the feedback path from the output transducer to the input transducer in question, the latter being measured at a number of frequencies.

5. A hearing aid according to claim 1 wherein the at least two input transducers are asymmetrically located relative to the output transducer.

6. A hearing aid according to claim 1 further comprising:

a BTE-part adapted for being located at or behind an ear (pinna) of the user, wherein the BTE-part and the ITE-part are electrically or acoustically connected to each other.

7. A hearing aid according to claim 6 wherein said ITE-part comprises a ventilation channel or other open structure allowing exchange of air between a volume near the ear drum and the environment, when the ITE-part is mounted at or in the ear canal of the user.

8. A hearing aid according to claim 7 wherein the at least two input transducers are asymmetrically located relative to the ventilation channel or to the other open structure.

9. A hearing aid according to claim 1 wherein the beamformer filter is configured to provide said spatially filtered signal as respective frequency sub-band signals.

10. A hearing aid according to claim 9 wherein the beamformer filter is configured to be individually set in an omni-directional or directional mode in the respective frequency sub-bands.

11. A hearing aid according to claim 9 wherein the controller is configured to select the spatially filtered signal or one of the electric input signals, or a signal originating therefrom, as the input signal to the signal processor, individually for different frequency ranges based on said frequency sub-band signals, and a feedback criterion.

12. A hearing aid according to claim 1 wherein said feedback measures are indicative of acoustic feedback or mechanical feedback.

13. A hearing aid according to claim 1 wherein the output transducer comprises a loudspeaker for providing the stimulus as an acoustic signal to the user or a vibrator for providing the stimulus as mechanical vibration of a skull bone to the user.

14. A method of operating a hearing aid adapted to be located at or in an ear of a user and to compensate for a hearing loss of the user, the method comprising providing at least two electric input signals representing sound in the environment of the hearing aid as picked up by respective at least two input transducers;

providing a spatially filtered signal based on said at least two electric input signals;

processing one or more of said electric input signals or one or more signals originating therefrom, and providing one or more processed signals based thereon;

generating stimuli for an output transducer perceivable by the user as sound based on said one or more processed signals;

estimating a current feedback from said output transducer to each of the at least two input transducers and providing respective feedback measures indicative thereof; and switching between two modes of operation of the hearing aid, a one-input transducer mode of operation, and a multi-input transducer mode of operation, in dependence of the feedback measures, wherein the hearing aid comprises an ITE-part adapted for being located at or in an ear canal of the user and the ITE-part comprises said at least two input transducers and said output transducer.

* * * * *